United States Patent [19]

Kawaguchi et al.

[11] Patent Number: 4,967,962

[45] Date of Patent: Nov. 6, 1990

[54] HIGH-PRESSURE FLUID PROCESSING MACHINE

[75] Inventors: Yutaka Kawaguchi; Shin Kasai; Michio Konno, all of Fukushima, Japan

[73] Assignee: Nitto Boseki Co., Ltd., Fukushima, Japan

[21] Appl. No.: 410,476

[22] Filed: Sep. 21, 1989

[30] Foreign Application Priority Data

Sep. 27, 1988 [JP] Japan ..... 63-125793

[51] Int. Cl.[5] ..... B08B 3/02

[52] U.S. Cl. ..... 239/263.1; 239/263.3; 239/225.1; 239/102.1; 134/144; 134/181

[58] Field of Search ..... 239/225.1, 227, 264, 239/265, 102.1, 263.1, 263.3; 118/323; 134/144, 145, 172, 180, 181

[56] References Cited

U.S. PATENT DOCUMENTS

| | | | |
|---|---|---|---|
| 3,271,102 | 9/1966 | Morgan | 8/151 |
| 3,801,275 | 4/1974 | Stankard et al. . | |
| 4,846,099 | 7/1989 | Krippl et al. | 239/102.1 |
| 4,852,595 | 8/1989 | Baier et al. | 239/263.1 |

FOREIGN PATENT DOCUMENTS

| | | | |
|---|---|---|---|
| 660580 | 2/1936 | Fed. Rep. of Germany | 239/225 |
| 1242656 | 8/1960 | France . | |
| 2090819 | 1/1972 | France . | |
| 2398138 | 2/1979 | France . | |
| 2021980 | 12/1979 | United Kingdom . | |
| 2047291 | 11/1980 | United Kingdom . | |

*Primary Examiner*—Andres Kashnikow
*Assistant Examiner*—Christopher G. Trainor
*Attorney, Agent, or Firm*—Sixbey, Friedman, Leedom & Ferguson

[57] ABSTRACT

A high-pressure fluid processing device is provided, which is improved for application of impinging fluid jets to process an object, such as a woven fabric, to increase uniformity of application and processing of the object. Particularly, the present invention is useful for processing woven fabrics having small thicknesses and lower densities by compensation for overlapping regions that occur during high-pressure fluid processing. The high-pressure fluid processing device includes a header means that is translationally rotationally driven from a frame so as to move a plurality of nozzles thereon in circles to impinged the object conveyed thereunder with high-pressure fluid jets. Moreover, the device includes masking members that are positioned between the nozzles and the object to be processed so as to block at least some of the jet flow of fluid to increase uniformity of processing and to avoid unwanted bunching or shifting of fibers in a processed fabric.

6 Claims, 3 Drawing Sheets

HIGH-PRESSURE FLUID PROCESSING MACHINE

BACKGROUND OF THE INVENTION

The present invention relates to a high-pressure fluid processing machine that can be effectively utilized for physically treating or opening the weave of a woven fabric of inorganic fibers or for the like. (the term "opening" as used herein meaning a "loosening a tightening mass condition of filaments composing a thread of the fabric"). Particularly, the present invention is useful for treating fabrics of smaller thicknesses and lower densities by compensating for overlapping regions that occur during high-pressure fluid processing.

Machines, which employ high-pressure fluids, are known for used in various fields, such as for cutting or drilling a slab of stone or concrete, the deburring of plastic moldings and so forth. In one type machine, high-pressure water, whose pressure In heightened to several thousand kilograms per square centimeter, is impinged onto an object to be processed, such as stone, by way of a small hole of 0.1 mm or less in diameter provided in a nozzle. Such a high-pressure water jet can be used to cut a piece from or drill the object by making use of the impulsive energy of the water.

A high-pressure fluid processing machine for processing a woven fabric of inorganic fibers by a high-pressure fluid has been proposed in commonly owned copending U.S. application Ser. No. 07/080,225 filed July 29, 1987, which is the equivalent of Japanese Unexamined Published Patent Application No. 230900/86. In the machine of application Ser. No. 080,225, a nozzle header is provided with a plurality of nozzles at prescribed intervals for impinging high-pressure fluid at the same prescribed intervals along the width of the woven fabric while the nozzle header is translationally revolved and the fabric is moved in a direction perpendicularly crossing the axis of the header. The result is that the high-pressure fluid is uniformly applied to the fabric to open or raise the fabric weave. The speed and radius of the translational revolution of the nozzle header, the interval between the nozzles, and the speed of the movement of the fabric are controlled depending on the kind and physical properties of the fabric, so that the high-pressure fluid is almost uniformly impinged onto the surface of the fabric. There are various types of woven fabrics which are made of inorganic fibers, such as fiberglass, including fabrics of dense structure having general utility, thin fabrics of thin fiberglass, and fabrics having a low density in the warp and weft of the weave. Some of these types of fabrics, however, develop problems when treated by high-pressure fluid which cannot be solved by controlling the speed and radius of the translational revolution of the nozzle head, the interval between the nozzles and the speed of the movement of the fabric; particularly the thin and low density fabrics.

FIG. 6 shows an example of the locus made on the surface of a woven fabric by a high-pressure fluid elected form one of the nozzles of the high-pressure processing machine as proposed in co-pending application 080,225, while the fabric is moved in the direction shown by the arrow. The portions A of the loop-shaped locus of the high-pressure fluid overlap with each other, as also shown in FIG. 6. Since the surface of the fabric is subjected to greater impulsive energy form the fluid at the mutually overlapping or adjoining portions of the locus than at the other portions of the fabric, the positions of the inorganic fibers of the fabric are likely to be shifted relative to each other at the mutually overlapping or adjoining portions of the locus. Such shifting of fibers becomes increasingly prevalent in smaller thickness fabrics and fabrics of low density. Thus, these certain type fabrics are no adequately treated by such a process.

SUMMARY OF THE INVENTION

It is thus an object of the present invention to provide a high-pressure fluid processing machine that solves the aforedescribed problems.

It is a further object of the present invention to provide a high-pressure fluid processing machine wherein the mutual overlapping or adjoining portions of loop-shaped loci that result on the surface of an object impinged with a high-pressure columnar-shaped fluid jets from nozzles is prevented. Moreover, the present invention avoids the concentration of the impulsive energy to the fluid jets to the overlapping or adjoining portions of the loci so as to more uniformly process the object. Provided is a machine having a nozzle header that is provided with the nozzles located at equal spaced intervals P along the width of the processed object and is attached to a frame so as to extend tranverse to the direction of movement of the object. Both of the ends of the nozzle header are coupled to coupling members, at least one of the coupling members being coupled to a driver, which is moved along a circle having radius e, so that the nozzles are moved along circles each having radius e. Masking members are interposed between the nozzles and the object to be processed so as to block at least a portion of the jet flow of the high-pressure fluid to uniformly apply the fluid to the wide area of the surface of the object. Thus uniformity in processing a wide article at continuous industrial running speeds is improved.

It is another object of the present invention to provide a high-pressure fluid processing machine with masking members that are interposed between a processed object and the nozzles, wherein the masking members are disposed, designed and positioned so that the portions of the loop-shaped loci made of the surface of the object by the high-pressure fluid jets, while the object is moved and the nozzle header is translated along a circle having a radius e, are prevented from overlapping with each other or adjoining each other. For that reason, a more uniform application of the impulsive energy of the high-pressure fluid in proved to the processed object. The high-pressure fluid processing machine is particularly effective when the processed object is a thin woven fabric or a less densely woven fabric of inorganic fibers to be processed without undergoing the thread slippage of the position of the thread of the fabric or the like.

In a high-pressure fluid processing machine constructed in accordance with the present invention, a flexible hose is coupled to the nozzle header to supply the high-pressure fluid to the nozzles and cause the formation of high-pressure columnar fluid jets from the nozzles. Both ends of the nozzle header are coupled to rotary shafts that are attached to the frame and located in mutually corresponding a positions thereon, so that the ends of the header are rotated along circles having radii e being eccentric to the rotary shafts. In other words, the nozzle header performs a translational circular motion with the radius e as the rotary shafts are rotated around the axes thereof. Therefore, the nozzles attached to the nozzle header are translated along circles having the same radius e. In operation, an object to be processed is moved beneath the header and between the frame while the high-pressure fluid is streamed from the nozzles to impinge on the surface of the object and the rotary shafts are rotated around the axes thereof. Thus, the fluid is impinged on the moving surface of the object while the nozzles are translated along the circles. The masking members, which are interposed between the nozzle header and the surface of the processed object are preferably made of stainless steel bars whose cross sections are shaped as circles, triangles, squares, slender oblongs or the like so that the masking members block at least some of the jet flow from the columnar jets of the high-pressure fluid streamed from the nozzles. The masking members may be disposed in various manners. In one preferred version, the members extend in parallel with each other. In another, the members are located so as to resemble a comb. In yet another, the members are made to intersect each other.

Preferably, The interval P between the nozzles, the diameter of each nozzle, the radius e, and the speed of the translational circular motion of each nozzle are set at 10mm to 20 mm, 0.1 mm to 0.5 mm, 10 mm to 30 mm and 100 rpm to 2,000 rpm, respectively. However, the interval P between the nozzles and the radius e of the translational circular motion of each nozzle may be otherwise appropriately set depending of the type of object to be processed and the speed of the movement thereof. If the interval P and the radius e are related to each other in accordance with the equation, $e<P/2$, then the high-pressure fluid would not be applied to some portions of the surface of the processed object. Therefore, the interval P and the radius e should not be related to each other as $e<P/2$. In other words, the equation $e \geqq P/2$ should be met, the pressure of the impinging high-pressure fluid is set between 10 kg/cm$^2$ to 3,000 kg/cm$^2$. However, it is preferable that the pressure is set between 10 kg/cm$^2$ to 200 kg/cm$^2$ if the processed object is a woven fabric of inorganic fibers.

DETAILED DESCRIPTION OF THE PREFERRED EMBODIMENTS

Plural embodiments of the present invention are hereafter described in detail with reference to the accompanying drawings attached thereto.

Figure 1:
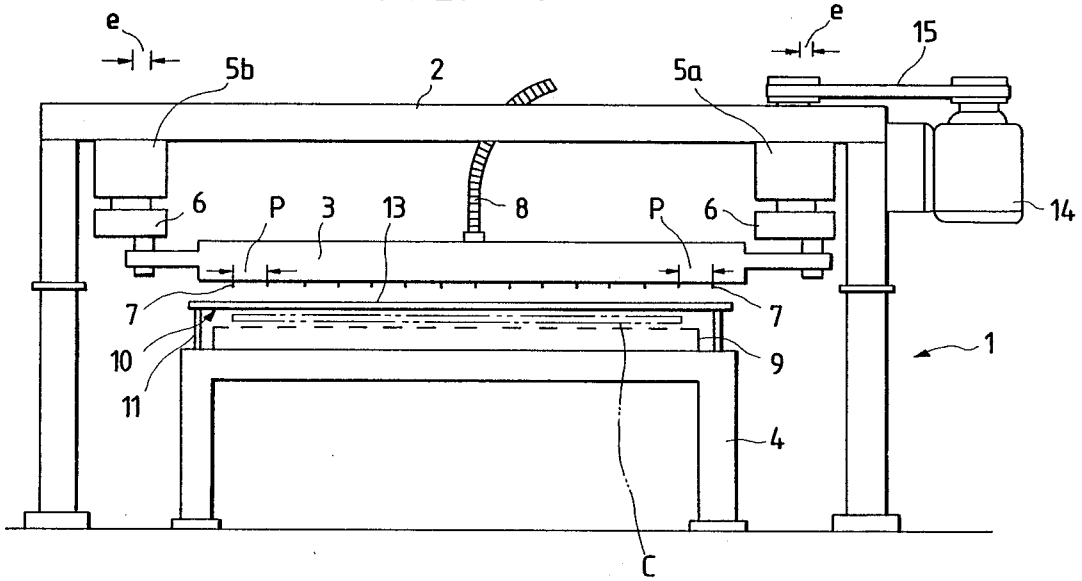
FIG. 1 is a front view of a high-pressure fluid processing machine constructed in accordance with the present invention.

FIG. 1 shows a high-pressure fluid processing machine 1. The machine 1 includes a frame 2 straddling across and over a passage defined for movement therethrough of an object for processing, a nozzle header 3, and a table 4. Rotary shafts **5*a* and 5*b* are attached to the upper portion of the frame 2 near both the ends of the upper portion of the frame 2. The shaft 5*a* is a driven shaft, while the other shaft 5*b* is an idle shaft. Cranks 6 are coupled to the rotary shafts 5*a* and 5*b* at one end of each of the cranks, and the ends of the nozzle header 3 are also rotatably coupled to the cranks 6. A plurality of nozzles 7 are provided in the nozzle header 3 and located a substantially equal spaced intervals P. A flexible a hose 8 is attached to the nozzle header 3 to supply a high-pressure fluid through the hose 8 to the nozzle header 3 and thus each nozzle 7. A carrier 9, from which water or the like can be easily discharged, is mounted on the table 4, and is used for conveying an object to be processed under the header 3 within the passage of the frame 2. The carrier 9** can be conventionally driven.

Figure 2:
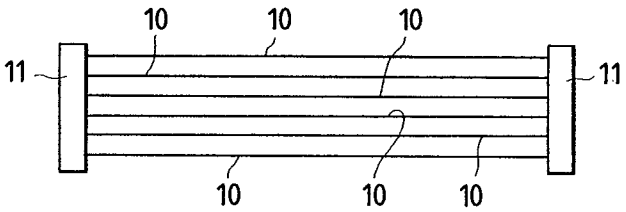
FIG. 2 is a plan view of one embodiment of the masking members of the machine.

Masking members 10 are interposed between the nozzle header 3 and the carrier 9 in such a manner that a gap is formed between the nozzle header 3 and the masking members 10 and another gap is made between the carrier 9 and the masking members 10. A motor 14 for driving the rotary shaft **5*a* is attached to the frame 2 so that the motive power of the motor 14 can be transmitted to the shaft 5*a* by way of a belt 15. The masking members 10 are preferably made of stainless steel, and in one embodiment, shown in FIG. 2, are supported at equal intervals in parallel with each other between support members 11 arranged at the ends of the masking members. The thickness or diameter of each masking member 10 is preferably between 1 mm and 1,5 mm. The length of each support member 11 is large enough to cover the diameter 2*e* of the circle of translational rotation of each nozzle 7. The number of the masking members 10 corresponds to the length of each support member 11**.

Figure 3:
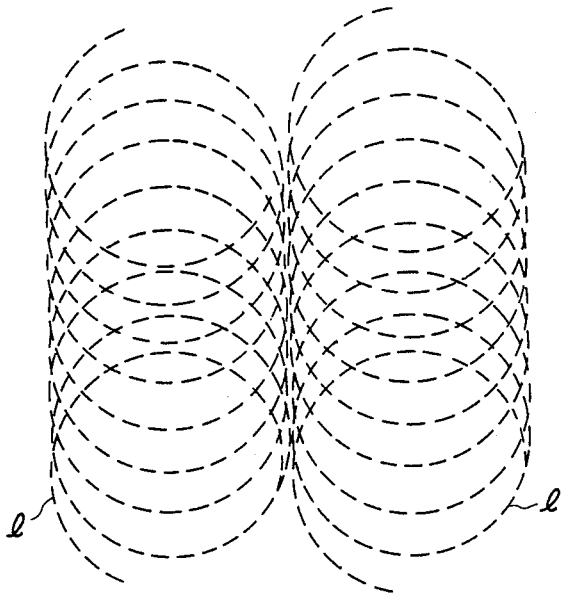
FIG. 3 is a view illustrating the loop-shaped loci made by the machine.

When an object is to be processed by the high-pressure fluid, the motor 14 is first put in action so that the rotary shaft **5*a* is rotated. As a result, the crank 6 coupled to the rotary shaft 5*a* is turned about the shaft. At that time, the other crank 6 coupled to the other rotary shaft 5*b* is also turned about the shaft by way to the nozzle header 3 acting as a link. therefore, the nozzles 7, provided in the nozzle header 3 coupled to the cranks 6, are translationally rotated so that each nozzle makes a circular locus whose radius is equal to the length e of the arm of each crank 6. In addition, the high-pressure fluid is supplied to the nozzle header 3 through the flexible hose 8 so that the fluid is streamed from the nozzles 7 is columnar jets to impinge on the surface of the object to be processed that is moving on the carrier 9. The impinged surface of the processed object is shown by a two-dot chain line in FIG. 1. As a result, the high-pressure fluid is streamed from each nozzle 7 to impinged on the surface of the processed object so as to make a loop-shaped locus of e in radius on the surface. Since the masking members 10 are located under the nozzles 7 between the processed object and the nozzles 7 to intermittently block the flow of the high-pressure fluid jet streams, the loop-shaped locus impinged on the surface of the object by the fluid streamed from each nozzle 7 is caused to be a dotted locus, as shown in FIG. 3**. Thereby, the impulsive energy of the high-pressure fluid impinged on the object is uniformly applied and the object is uniformly processed.

Figure 4:
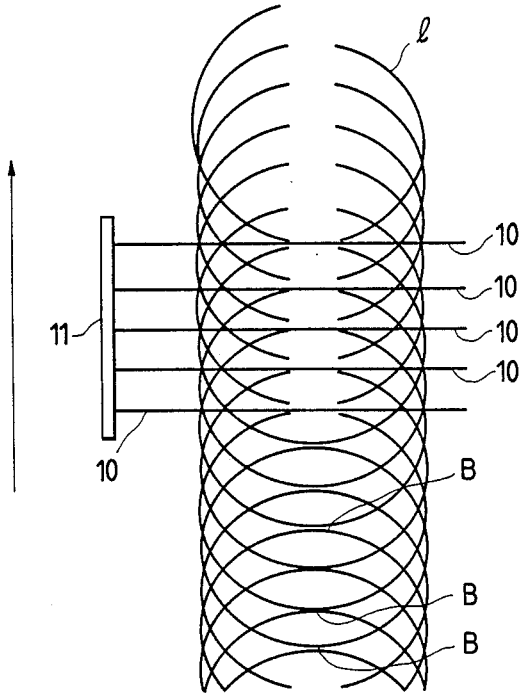
FIG. 4 is a view illustrating the loop-shaped loci made by a high-pressure processing machine using another embodiment of the masking members formed in accordance with the present invention.

FIG. 4 shows the loop-shaped loci made by a high-pressure fluid jet impinged on to an object to be processed from the nozzles 7 of a high-pressure fluid processing machine which is another embodiment in accordance with the present invention. In this machine, the high-pressure fluid is streamed from the plural nozzles 7 to impinge on the surface of the processed object while a nozzle header 3 performs a translational circular motion and the object is moved in a direction as shown by an arrow in FIG. 4. As a result, the loop-shaped loci are made on the object by the fluid. The machine has masking members 10 for preventing the loop-shaped loci from overlapping with each other at the portions B thereof. As a result, the loop-shaped loci are erased at the portions B thereof, so that the processed object is prevented from receiving greater impulsive energy form the high-pressure fluid that would result from the double application of the fluid to the object. Thereby, the processed object is effectively protected from damage, such as would occur by the thread slippage of the position of the inorganic thread of a thin woven fabric, as described above in the Background Section. Since the portions B of the loop-shaped loci are small in size and the high-pressure fluids acts not only to the directly impinged points of the processed object but also to the areas in vicinity of the impinged points, the object is processed uniformly as a whole by the fluid. Moreover, since the portions of the loop-shaped loci, which would overlap with each other or adjoin each other if the masking members 10 were not provided, depend on the interval between the nozzles, the radius of the translational circular motion of the nozzles and the speed of the movement of the processed object, then the interval between nozzles, the radius, and the speed should be appropriatedly predetermined.

Figure 5:
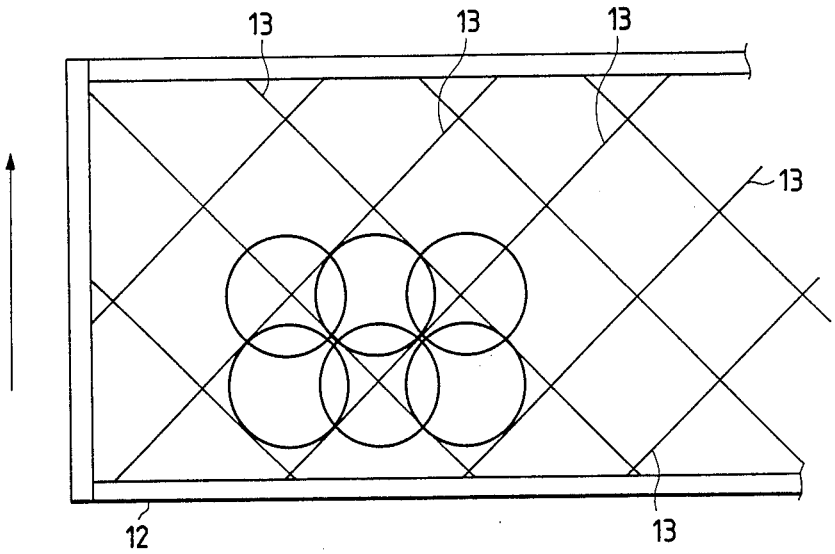
FIG. 5 is a view illustrating yet another embodiment of the masking members which are modifications of those of the machines shown in FIGS. 1, 2 and 4.
Figure 6:
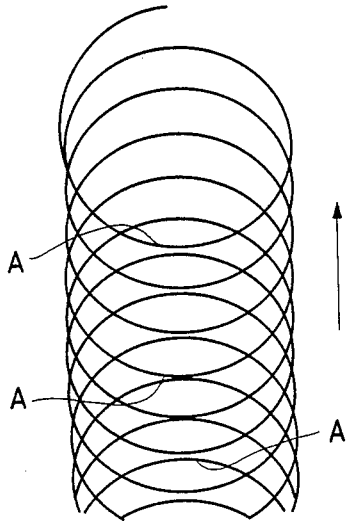
FIG. 6 is a view illustrating the loop-shaped loci made by a conventional high-pressure fluid processing machine.

In another embodiment shown in FIG. 5, masking members 13 are provided which are modifications of those shown in FIGS. 2 and 4 at 10. The masking members 13 are attached to a support member 12 in such a manner that the masking members intersect each other perpendicularly and extend at an angle of 45° to the direction of the movement of a processed object, which is shown by an arrow in FIG. 5. The circles shown in FIG. 5 represent the circular loci of three mutually-adjacent nozzles. The circular loci intersect each other. The radius e of each of the circular loci and the interval P between the nozzles have a relationship of $e>P/2$. The masking members 13 intersecting each other act so that the loop-shaped loci, impinged on the surface of the processed object by a high-pressure fluid streamed from the nozzles, are kept from overlapping with each other at the portions of the loci. For that reason, the processed object is prevented from receiving excessive impulsive energy from the high-pressure fluid. The masking members 13 are particularly effective when the processed object is a woven fabric of inorganic fibers or the like.

What is claimed is:

1. A high-pressure fluid processing device for processing an object moved relative thereto such as a woven fabric comprising:

a means for conveying the object to be processed, a frame means positioned astride said conveying means, a header means having a plurality of spaced nozzles for producing a fluid jet flow from said nozzles, said nozzles to be located at equal spaced intervals along the width of the object to be processed, wherein said header means is coupled to said frame means by a crank means that is rotationally driven by a drive means to cause translational rotation of said header means and circular movement of said nozzles; and masking means positioned between said header means and the object on said conveying means to block at least some of the jet flow provided from said nozzles when said nozzles are moved in a circle wherein the masking means includes at least one member that is disposed in a manner such that portions of loop-shaped loci, that are formed on the surface of the object processed by said jet flow impinging the object while the nozzles are moved along the circle and the object is moved by said conveying means, are prevented from overlapping with and adjoining each other.

2. The high-pressure fluid processing device of claim 1, wherein said masking means comprises a plurality of elongate members arranged parallel to each other at equal spaced intervals and supported at ends thereof by support means.

3. The high-pressure fluid processing device of claim 1, wherein said masking means includes a plurality of elongate members that intersect each other perpendicularly and extend at an oblique angle to the direction of travel of the object by said conveying means, said members supported in position by support means.

4. The high-pressure fluid processing device of claim 1, wherein the jet flow is provided at a pressure between 10 $kg/cm^2$ and 3,000 $kg/cm^2$ and the nozzles a moved in said circles at a speed of 100 to 2,000 rpms.

5. The high-pressure fluid processing device of claim 4, wherein the radius of the circle that said nozzles are moved in is not less than half of the distance of the spaced interval between said nozzles.

6. The high-pressure fluid processing device of claim 5, wherein the spaced interval between said nozzles is between 10 and 20 mm, the diameter of each nozzle is 0.1 to 0.5 mm, and the radius of said circle is between 10 and 30 mm.

* * * * *